United States Patent [19]

Ideta

[11] Patent Number: 4,531,898

[45] Date of Patent: Jul. 30, 1985

[54] CONTROL SYSTEM FOR A VANE TYPE VARIABLE DISPLACEMENT PUMP

[75] Inventor: Yasufumi Ideta, Sagamihara, Japan

[73] Assignee: Nissan Motor Co., Ltd., Yokohama, Japan

[21] Appl. No.: 561,032

[22] Filed: Dec. 13, 1983

[51] Int. Cl.[3] ..... F04C 2/00; F04C 15/04

[52] U.S. Cl. ..... 418/26; 418/27; 418/30; 417/220

[58] Field of Search ..... 417/220; 418/24–27, 418/30

[56] References Cited

U.S. PATENT DOCUMENTS

| | | | |
|---|---|---|---|
| 2,823,614 | 2/1958 | Lapsley | 417/220 |
| 2,878,755 | 3/1959 | O'Conner et al. | 417/220 |
| 2,894,458 | 7/1959 | Hallman | 418/27 |
| 3,238,884 | 3/1966 | Wright | 417/220 |
| 3,743,445 | 7/1973 | Dworak et al. | 417/220 |

FOREIGN PATENT DOCUMENTS

| | | | |
|---|---|---|---|
| 0049838 | 4/1982 | European Pat. Off. | 418/30 |

*Primary Examiner*—John J. Vrablik
*Assistant Examiner*—Theodore Olds
*Attorney, Agent, or Firm*—Schwartz, Jeffery, Schwaab, Mack, Blumenthal & Evans

[57] ABSTRACT

There is provided a control device for a vane type variable displacement pump. The control device eliminates the need of a hydraulic cylinder to control the eccentricity of a cam ring of the vane pump. A pressure difference between a second chamber and a high pressure side of the pump first chamber on a low-pressure side of the vane pump is utilized to determine the eccentricity of the cam ring. A regulator valve is connected to the first chamber and with the second chamber in order to allow or prevent communication between the two chambers. A spring is also provided to always force the cam ring in a direction so as to make the eccentricity of the cam ring larger.

8 Claims, 2 Drawing Figures

CONTROL SYSTEM FOR A VANE TYPE VARIABLE DISPLACEMENT PUMP

BACKGROUND OF THE INVENTION

The present invention relates to a control system for a vane type variable displacement pump.

The prior art contains a control device for a vane type variable displacement pump, such as that shown in FIG. 1. A cam ring 1 of a vane type pump is pivotally mounted at a protrusion thereof to a support member of the pump by a pin 2, which serves as a fulcrum. Provided radially inward of the cam ring 1 is a rotor 4 having a plurality of vanes 3 which are slidable through the rotor 4 in a radial direction. The opposed faces of each pair of adjacent vanes 3 define, along the arc of the radial outward surface of the rotor 4 and the interior surface of cam ring 1 which the pair of vanes intersect, chambers which rotate and change in volume depending on angular position. The cam ring 1 is arranged in a variable eccentric relationship with the rotor 4. The cam ring 1 also has a lever 1*a* which is integrally formed on and extends from the cam ring 1 to receive a force due to a spring 5 and a force due to a piston rod 6*a* of a hydraulic cylinder 6 acting oppositely on the lever 1*a*, so that the balance of both forces determines the amount of eccentricity of the cam ring. In FIG. 1, the rotor 4 rotates in a clockwise direction, so that hydraulic fluid is drawn from a reservoir 7 by a suction port 1*b* through an oil line 8, and the pressurized hydraulic fluid is delivered from a delivery port 1*c* to an oil line 9. The pressurized hydraulic fluid at the oil line 9 is regulated to a predetermined pressure (line pressure) by a control valve 10, and is delivered to hydraulic equipment, such as a clutch, which is not shown. The oil line 9 is also leads to a regulator valve 11. The regulator valve 11 acts to apply the line pressure to a hydraulic cylinder 6 through an oil line 12 when the line pressure in the oil line 9 is higher than a preset pressure, and to exhaust the hydraulic fluid from the hydraulic cylinder 6 to the reservoir 7 when the line pressure is below the preset pressure. With such a construction, when a rotating speed of the rotor 4 is low, substantially no hydraulic pressure is supplied to the hydraulic cylinder 6 so that the bias force of the spring 5 encounters substantially no resistance from the piston rod 6*a* and the amount of the eccentricity becomes maximum, whereas when the rotating speed of the rotor is high, the line pressure is supplied to the hydraulic cylinder 6 and the amount of the eccentricity becomes small. In this manner the amount of delivery at a low rotating speed can be assured while energy loss at a high rotating speed can be reduced.

However, in a control device for such a prior art vane type variable displacement pump as described above, problems exist such as follows. Namely, since a hydraulic cylinder has to be used to control the amount of the eccentricity of the cam ring in the control device, a large number of parts are required, and thus its cost becomes high and moreover, a large space is required.

SUMMARY OF THE PRESENT INVENTION

Accordingly, it is the primary object of the present invention to eliminate these problems of a prior art control device for a vane type variable displacement pump which have been already described.

Another object of this invention is to provide an inexpensive control device for a vane type variable displacement pump by eliminating the need of a hydraulic cylinder to control the eccentricity of a rotor therein.

This is accomplished by allowing or preventing communication between a first chamber at an angular position on the high-pressure side of the pump and a second chamber an the low-pressure (section) side of the pump through utilization of a regulator valve. The regulator valve is operated by a pilot pressure which is led from the delivery side of the pump. The eccentricity of the cam ring of the pump is determined by a pressure difference between the first chamber and second chamber portion. A spring is also provided to always force the cam ring in the direction which produces a larger eccentricity of the cam ring.

BRIEF DESCRIPTION OF THE DRAWINGS

The invention will be described with reference to the accompanying drawings, in which.

DETAILED DESCRIPTION OF THE INVENTION

Figure 1:
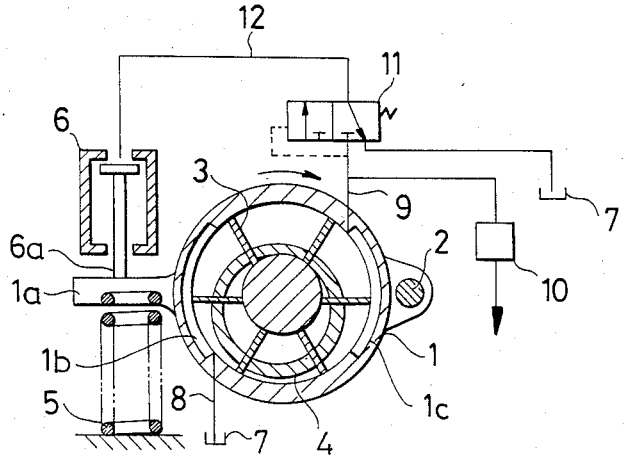
FIG. 1 PRIOR ART
FIG. 1 is a schematic view of a prior art control device for a vane type variable displacement pump.

In the following, a detailed description of the present invention will be made with reference to FIG. 2 which shows an embodiment of the present invention.

Firstly, the construction of a pump incorporating a control device according to the present invention will be described.

A cam ring 21 is pivotally mounted at a protrusion thereof to a support member of the pump by a pin 22, which acts is its fulcrum. Provided radially inward of the cam ring 21 is a rotor 24 having vanes 23 which are slidable through the rotor 24 in a radial direction. Each pair of adjacent vanes defines therebetween, with the rotor and cam ring, a chamber. The cam ring 21 also has a lever 21*a* which is integrally formed on and extends radially from the outer periphery of the cam ring 21 to receive a force due to a biasing means such as a spring 25. The cam ring 21 is inclined to turn in a clockwise direction by the bias force of the spring to the lever 21*a*. Thus, the spring 25 and the lever 21*a* form a positioning means to pivot the cam ring 21 about the fulcrum pin 22. In FIG. 2, when the rotor 24 disposed in an eccentric relationship with the cam ring rotates in the clockwise direction, hydraulic fluid is drawn into a suction port 21*b* from a reservoir 27 through an oil line 28, while a pressurized hydraulic fluid is delivered into an oil line 29 from a delivery port 21*c*. The eccentricity between the cam ring and the rotor is varied by the pivotal movement of the cam ring. The pressurized hydraulic fluid at the delivery port 29 or in the oil line 29 is regulated to a predetermined pressure (line pressure) by a control valve 30, and is supplied to hydraulic equipment such as a clutch which is not shown. The line pressure of the oil line 29 is led to a control means such as a regulator valve 31 having first and second shift modes for pilot pressure. The operation of the control means is described hereinafter. The regulator valve 31 is connected to an oil line 33 which communicates with the interior of cam ring 21 at a second position, and to an oil line 34 which communicates with the interior of cam ring 21 at a first position diametrically opposed to said second position. For the purpose of the following discussion and the appended claims, that chamber which has passed by the suction port 21*b* is the first chamber. Similarly, that chamber which has passed by the delivery port 21*c* is the second chamber. In the preferred embodiment, these two chambers are diametrically opposed. The chambers alternate in becoming the first chamber and second chamber as rotor 24 rotates. Each chamber assumes the identity of first chamber and second chamber once per revolution. There is never more than one first chamber or second chamber. A chamber has "passed by" a port, e.g., suction port 21*b*, when the trailing vane defining the chamber rotates past the upper clockwise edge of the port. Thus, "passed by" is meant to imply that the port which is passed by is port which the chamber has more recently passed. As illustrated in FIG. 2, oil line 33 communicates with the chamber occupying the angular positions corresponding to the second chamber, and oil line 34 communicates similarly with a first chamber. When the line pressure as a pilot pressure is higher than a preset pressure, both of the oil lines 33 and 34 are shut off, whereas when the line pressure is below the preset pressure, both of the oil lines 33 and 34 are communicated with each other.

The operation of the control device according to the present invention will be described hereinafter.

Figure 2:
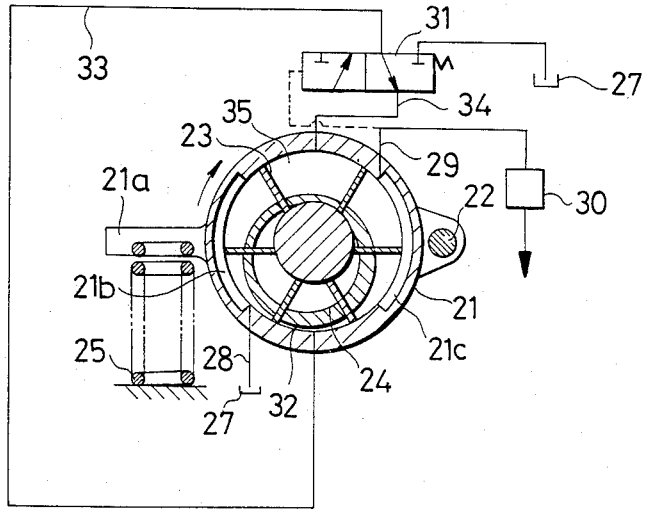
FIG. 2 is a schematic view a control device for a vane type variable displacement pump according to the present invention.

As the rotor 24 rotates in the clockwise direction as shown in FIG. 2, the hydraulic fluid inside the reservior 27 is drawn into the suction port 21*b* through the oil line 28, and the hydraulic fluid is delivered into the oil line 29 from the delivery port 21*c*. It will be noted that the hydraulic fluid is trapped between vanes at two portions (at a suction side and at a delivery side), namely, in a first chamber 35 as shown in the upper side of FIG. 2 and in a second chamber 32 as shown in the lower side of FIG. 2. As described previously, the second chamber 32 and the first chamber 35 are respectively communicated with the regulator valve 31 by the oil lines 33 and 34. Meanwhile, since the second chamber 32 is supplied with and can maintain the delivery pressure (line pressure) at the delivery port 21*c*, the pressure in second chamber 32 is kept approximately equal to the line pressure, and on the other hand, since first chamber 35 has been subjected to and keeps a decreased pressure of the suction port 21, the pressure in first chamber 35 is substantially zero. A control device of a vane type variable displacement pump according to the present invention controls the amount of eccentricity of the cam ring 21 utilizing a pressure difference between the both chambers 32 and 35. When the line pressure does not reach the preset pressure of the regulator valve 31 because of a low speed of the rotor 24, the regulator valve 31 in a first shift mode allows communication between the oil line 33 and the oil line 34. In other words, it allows communication between the first chamber 35 and the second chamber the delivery 32. Thus, a higher hydraulic pressure at the delivery second chamber 32 is led to first chamber 35, causing the hydraulic pressure at both side chambers to become approximately equal to the line pressure. For this reason, no force resulting from the hydraulic pressure acts upon the cam ring 21. Accordingly, the cam ring 21 is pushed to a position of a maximum eccentricity by a bias force of the spring 25, and a delivery volume is made large. When the rotating speed of the rotor 24 is increased and thus the delivery is increased, the line pressure may exceed the preset pressure of the regulator valve 31. Then, the regulator valve is shifted to a second shift mode, and the communication between the oil line 33 and the oil line 34, that is, between first chamber 35 and second chamber 32, is shut off. At this time, since the hydraulic fluid in second chamber 32 is not supplied to first chamber 35, the hydraulic pressure at first chamber 35 will become substantially zero. Since a hydraulic pressure approximately equal to the line pressure is acting on the second chamber 32, a force turning the cam ring 21 in a counterclockwise direction in FIG. 2 will be imposed thereon. Therefore, the amount of the eccentricity of the cam ring is reduced and a delivery volume is reduced. The higher the line pressure, the larger will be the force acting on the cam ring 21 from second chamber 32, and the larger in this force in turn, the smaller will be the amount of the eccentricity, and thus there will be reduced delivery. Accordingly, the cam ring 21 is balanced at a predetermined position and supplies a minimum required amount of hydraulic fluid required for the whole hydraulic circuit including leakages at the control valve 30, each oil line, clutches etc.

Further, in the above embodiment, although the preset pressure of the regulator valve 31 is made constant by the bias force of a spring, for instance, in such a case that it is desired to increase the delivery temporarily corresponding to the operating conditions of the equipment using this pump, the preset pressure can be varied by imposing a predetermined hydraulic pressure on the regulator valve 31.

As described above, according to the present invention, an oil line communicating with a second chamber of a pump and an oil line communicating with a first chamber of the same are led to a regulator valve, which has a first shift position wherein the oil lines are communicated with each other and a second shift position wherein the communication of the oil lines is shut off. The delivery pressure of the pump is led to the regulator valve as a pilot pressure. When the pump delivery pressure is below a preset pressure, the regulator valve is made to be in the first shift position, whereas when the pump delivery pressure is higher than the preset pressure, the regulator valve is made to be in the second shift position. In addition, a spring is provided to always impose a bias force so as to pivotally turn the cam ring in a direction which produces a larger eccentricity. As a result, a hydraulic cylinder for pivotally turning the cam ring is unnecessary in the present invention. Thus such effects as a lower cost of the pump and a compact control device for the pump have been obtained.

While preferred embodiments of this invention have been shown and described, it will be appreciated that other embodiments will become apparent to those skilled in the art upon reading this disclosure, and, therefore, the invention is not to be limited by the disclosed embodiments, except as required by the hereto appended claims.

What is claimed is:

1. A vane type variable displacement pump comprising:

a cam ring having a protrusion extending radially outward from said cam ring and mounted to a support member of said pump at said protrusion with a pin so as to permit pivotal movement of said cam ring about said pin, said cam ring having a suction port to draw in hydraulic fluid and a delivery port to discharge said hydraulic fluid, a rotor provided radially inward of said cam ring in an eccentric relationship with said cam ring wherein the eccentricity is varied by the pivotal movement of said cam ring, a plurality of vanes each provided radially slidably through said rotor to come in abutting engagement with an inner surface of said cam ring during rotation, each pair of said vanes defining a chamber together with said cam ring and said rotor, each said chamber communicating with said suction and delivery ports when each said chamber passes by said suction and delivery ports during rotation, a positioning means for rotating said cam ring in a direction to make said eccentricity larger, and a control means connected to a first chamber which has passed by said suction port and to a second chamber which has passed by said delivery port, said control means being adapted to allow the communication between said first and second chambers when the pressure at the delivery port is lower than a preset pressure and to block the communication between said first and second chambers when the pressure at the delivery port is higher than said preset pressure, wherein blocking the communication of said first and second chambers creates a force that opposes the positioning means.

2. The vane type variable displacement pump of claim 1, wherein said first chamber is adapted to substantially keep the pressure at said suction port, whereas said second chamber is adapted to substantially keep the pressure at said delivery port.

3. The vane type variable displacement pump of claim 1, wherein said control means comprises a regulator valve having first and second shift modes, wherein said regulator valve allows the communication between said first and second chambers in said first shift mode and shuts off said communication in said second shift mode.

4. The vane type variable displacement pump of claim 3, wherein said regulatory valve communicates with said first and second chambers through hydraulic lines.

5. The vane type variable displacement pump of claim 1, wherein said positioning means comprises a lever extending radially outwardly from the outer periphery of said cam ring and a biasing means for forcing said lever in a direction, and wherein the force of said biasing means is opposed to the rotation of said cam ring caused by a difference in pressure between said first and second chambers.

6. The vane type variable displacement pump of claim 3, wherein in said first shift mode, said cam ring turns due to the force of said biasing means to make said eccentricity larger.

7. The vane type variable displacement pump of claim 3, wherein in said second shift mode, said cam ring turns against the force of said biasing means so as to make said eccentricity smaller.

8. The vane type variable displacement pump of claim 1, wherein said pressure at the delivery means is controlled by a control valve means.

* * * * *